US006740632B1

(12) United States Patent
Jacob et al.

(10) Patent No.: US 6,740,632 B1
(45) Date of Patent: May 25, 2004

(54) PROCESS FOR MANUFACTURING INDUSTRIAL DETERGENT AND COMPONENTS THEREOF

(75) Inventors: Michael Jacob, Weimar (DE); Karlheinz Rümpler, Weimar (DE)

(73) Assignee: Glatt Ingenieurtechnik GmbH, Weimar (DE)

( * ) Notice: Subject to any disclaimer, the term of this patent is extended or adjusted under 35 U.S.C. 154(b) by 0 days.

(21) Appl. No.: 09/609,110

(22) Filed: Jun. 30, 2000

(30) Foreign Application Priority Data

Feb. 18, 2000 (EP) ..... 00103515

(51) Int. Cl.[7] ..... C11D 11/00
(52) U.S. Cl. ..... 510/444; 23/313 FB
(58) Field of Search ..... 510/444; 23/313 FB

(56) References Cited

U.S. PATENT DOCUMENTS

| | | | | | |
|---|---|---|---|---|---|
| RE32,307 | E | * | 12/1986 | Glatt et al. | 366/102 |
| 4,689,297 | A | * | 8/1987 | Good et al. | 435/174 |
| 4,734,290 | A | * | 3/1988 | Meyer | 426/302 |
| 4,919,847 | A | * | 4/1990 | Barletta et al. | 510/442 |
| 5,133,137 | A | * | 7/1992 | Petersen | 34/57 A |
| 5,516,447 | A | * | 5/1996 | Bauer et al. | 510/535 |
| 5,629,275 | A | | 5/1997 | Bauer et al. | 510/108 |
| 5,695,701 | A | * | 12/1997 | Funder et al. | 264/117 |
| 5,814,501 | A | * | 9/1998 | Becker et al. | 435/174 |
| 6,030,937 | A | * | 2/2000 | Kruse et al. | 510/443 |

FOREIGN PATENT DOCUMENTS

| | | |
|---|---|---|
| EP | 0353976 A1 * | 2/1990 |
| EP | 0 767 703 B1 | 4/1997 |
| GB | 1341557 | 12/1973 |
| WO | WO 99/25805 | 5/1999 |

* cited by examiner

*Primary Examiner*—Lorna M. Douyon
(74) *Attorney, Agent, or Firm*—Akin Gump Strauss Hauer & Feld, L.L.P.

(57) ABSTRACT

A process is provided for manufacturing industrial detergents and industrial detergent components in granular or agglomerate form on a dry basis in an essentially horizontally oriented fluidized bed. The finished detergent granulates or agglomerates are distinguished by a homogenous composition of the individual raw material components, including the binder and the moisture content, have a high resistance to mechanical stress, are readily dispersible in water, and are low in dust or almost dust-free. In the process a binder and/or components in the form of solutions, suspensions, or melts are added to the solid material in the fluidized bed via a spray or injection system. Through the energy introduced via the process air, drying and compacting of the agglomerate granulate forming in the injection area of the fluidized bed occur. The supply temperature of the process air is in a range of about 20° C. up to the decomposition temperature of the individual materials. By adjusting the drying parameters, the product moisture can be varied. The particles entrained by the process air from the fluidized bed are separated from the air in an expansion zone provided with cross-sectional widenings integrated into the fluidized bed apparatus and in a filter system connected to it, and are conveyed back into the fluidized bed and agglomerated there. A low-dust or dust-free product results that having a granularity range of about 0.2 to 2.0 mm.

17 Claims, 1 Drawing Sheet

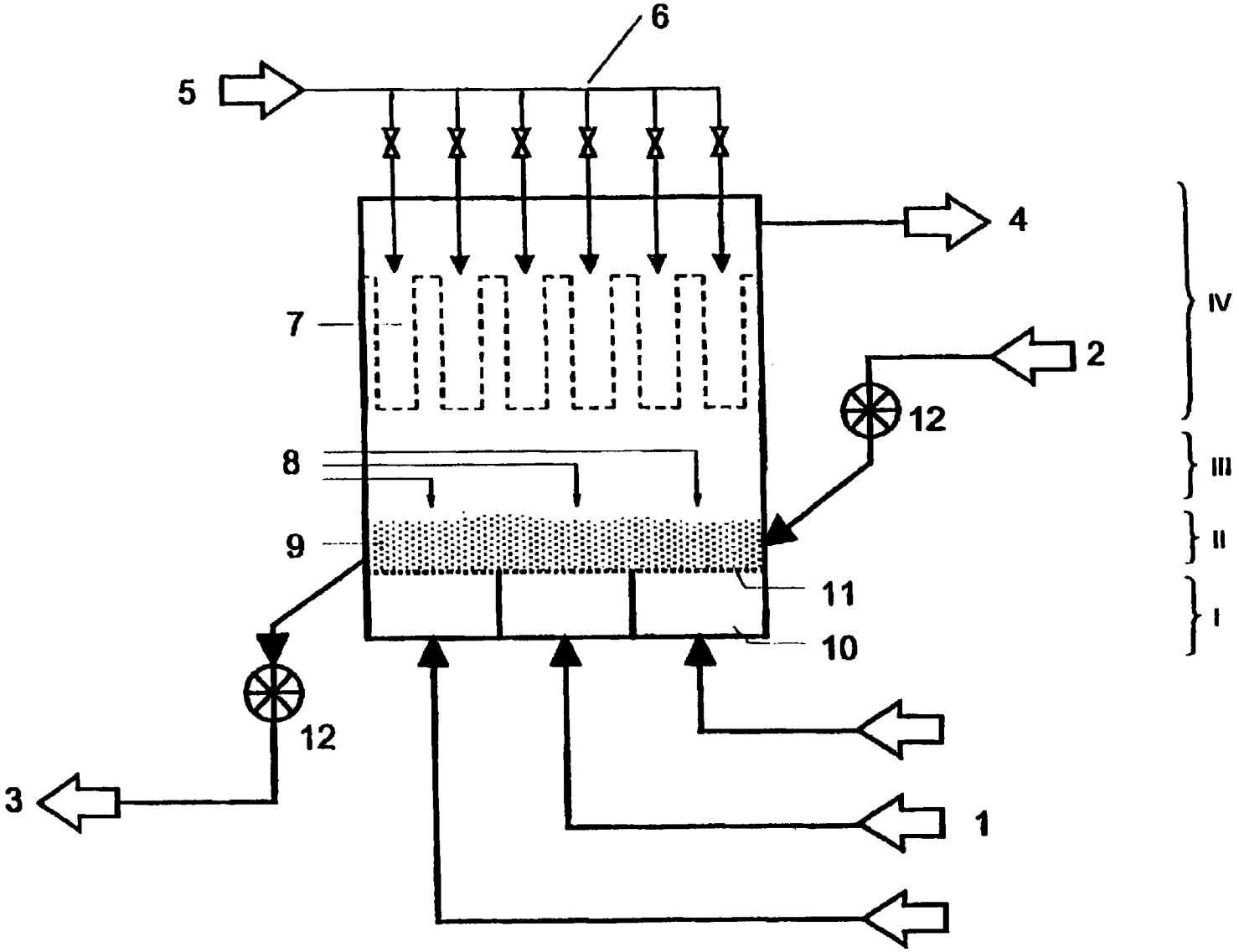
IV
III
II
I
2
4
12
1
11
10
6
7
8
9
12
5
3

PROCESS FOR MANUFACTURING INDUSTRIAL DETERGENT AND COMPONENTS THEREOF

BACKGROUND OF THE INVENTION

The invention relates to a process for manufacturing industrial detergents and industrial detergent components in granular or agglomerate form on a dry material basis in an essentially horizontally oriented fluidized bed.

It is known in the production of detergents or industrial detergent components to manufacture the respective individual components by spray drying or spray granulation and then to mix the so-manufactured individual components according to the formula. A unification of different individual particles does not occur with the mixing by this process.

It is disadvantageous that, depending on the quality of the mixing of the an individual components, a more or less non-homogenous distribution of the different component results. During transport and in storage the components can easily become separated inside the packaging or container. Due to the large proportion of dust and the tendency toward separation, the quality of the detergent or detergent components is considerably worsened. This acts in a very disadvantageous manner, since in most cases these dusts are to be classified as harmful to health. Furthermore, with increasing particle sizes there exists an ever-increasing tendency toward dust explosions.

SUMMARY OF THE INVENTION

An object of the invention is to develop a process for manufacturing industrial detergents and industrial detergent components in granular or agglomerate form on a dry basis, which distinguish themselves from the known granulates by a homogenous composition of the granulate or agglomerate composed of the individual raw material components, including the binder and the moisture content, which have a high resistance to mechanical stresses, which are easily dispersible in water, and which are low in dust or almost dust-free.

The above object is achieved according to the invention by the process for manufacturing industrial detergents and industrial detergent components as a finished product in granulate or agglomerate form on a dry basis in an essentially horizontally oriented fluidized bed, comprising:

a) performing different process steps, including heating, agglomeration, coating, drying and cooling, for manufacturing the finished product in a single or multiple stage fluidized bed;

b) supplying solid powdered starting material in a first process step to the fluidized bed in an area of fluidizing space;

c) supplying process air to the different process steps from beneath the fluidized bed, wherein a process temperature or supply temperature for agglomeration of the product is a function of a decomposition temperature of individual material components of the finished product and lies in a range of about 20 to 300° C., and the process air for cooling has a temperature g in a range of about −20 to +30° C.;

d) supplying a binder, water and/or one or more material components in the form of solutions, suspensions or melts to the solid in the fluidized bed in the area of the fluidizing space over an entire process range using a spray or injection system, wherein the dry portion in the spray medium comprises 0 to 100%;

e) fluidizing the individual components in the area of the fluidizing space to form a solid mixture comprising granulates of homogenous composition;

f) reducing a flow speed of the process air supplied from below to the fluidizing space in an expansion zone located above the fluidizing space and formed by cross-sectional widenings, such that a pre-separation of particles entrained from the fluidizing space and a return of the pre-separated particles into the fluidizing space occur; and g) separating process dust with a dedusting mechanism in an integrated filter system adjoining above the expansion zone and returning the process dust to the fluidizing space. Advantageous embodiments of the process are set forth in dependent claims.

The manufacture of the product is accomplished by fluidized bed agglomeration/granulation in an essentially horizontally oriented fluidized bed. In the process, a binder and/or components in the form of solutions, suspensions, or melts are to added to the solid material in the fluidized bed via an injection system. The binder content in the product can amount to about 1 to 35 mass percent. Through the energy introduced via the process air, drying and compacting of the agglomerate/granulate forming in the injection area of the fluidized bed occur. In this connection, the supply temperature of the process air is from about 20° C. up to the decomposition temperature of the individual materials. By adjusting the drying parameters, the product moisture can be varied. Values starting at 0 mass percent upwards are possible depending on the liquid intake. The particles entrained by the process air from the fluidized bed, particularly the fine dust, are separated from the air in an expansion zone provided with cross-sectional widenings integrated in the fluidized bed apparatus and in a filter system connected to it, and are conveyed back into the fluidized bed and agglomerated there. A low-dust or dust-free product thereby results having a granularity range of about 0.2 to 2.0 mm.

The above-described process for manufacturing the end product is carried out in different process stages, for example heating up, agglomeration, coating, drying, and cooling, one after the other, in a single or multiple stage fluidized bed.

The advantage of the process according to the invention for manufacturing industrial detergents and industrial detergent components in granular or agglomerate form on a dry basis consists in that by the fluidization of the material in the fluidized bed, a uniformly homogenous composition of individual granules or agglomerates results from the individual raw material components including the binders and the appropriate moisture. A separation of the components can thus no longer occur.

The granulate or agglomerate exhibits a unified quality. The manufacture of the granules or agglomerate using fluidized bed agglomeration/granulation furthermore has the advantage that a solid, final product results having little rub-off and little dust, and which is easily dispersible in water.

A further advantage of the process according to the invention consists in that by the complete encapsulation of the process by carrying out the process guidance in a single apparatus, a health risk by contact with the supplied dusts is prevented; In addition, the region of the dust explosion danger is reduced to the interior of the fluidized bed apparatus.

BRIEF DESCRIPTION OF SEVERAL VIEWS OF THE DRAWINGS

The foregoing summary, as well as the following detailed description of the invention, will be better understood when read in conjunction with the appended drawing. For the purpose of illustrating the invention, there is shown in the drawing an embodiment which is presently preferred. It should be understood, however, that the invention is not limited to the precise arrangements and instrumentalities shown. In the drawing:

The sole FIGURE is a cross-sectional schematic view through a fluidized bed granulation system for carrying out the process of the invention.

DETAILED DESCRIPTION OF THE INVENTION

The process for manufacturing industrial detergents and industrial detergent components in granular or agglomerate form on a dry basis is accomplished by fluidized bed agglomeration/granulation in a single or multiple stage fluidized bed granulation system, wherein the different process steps or stages for manufacturing the end product, such as heating, agglomeration, coating, drying and cooling, are performed in sequence in a fluidized bed 9.

The powdered starting material is supplied via the solid material intake 2 and a cellular wheel sluice 12 as a pressure lock for enclosing the first process stage in the area of the fluidizing space II of the fluidized bed. Corresponding to the specific material conditions, the supplied material passes through the different process stages, such as heating, agglomeration, coating, drying and cooling. Process air 1 at different temperatures is supplied to the respective process stage via air supply chambers 10 and an air distribution plate 11 of the fluidized bed 9. The air supply chambers 10 and the air distribution plate 11 thereby form, as the upper boundary, the inflow section 1, in which the process air 1 is introduced into the fluidized bed A, distributed and homogenized.

The temperature of the process air 1 for the agglomeration of the product is a function of the decomposition temperature of the separately introduced material components and ranges, according to the material components, from about 20 to 300° C. The process air 1 for the cooling of the already granulated and dried material is supplied at the end of the process stages before the area of the product discharge 3. The temperature of the process air 1 for the cooling lies in the range of about −20 to +30° C. and also depends on the individual material components in the final product. Thus, the optimal conditions for the process in the fluidized bed 9 are created by adjustment of the respective bed temperature.

The fluidizing space II is formed in its lower region by the air distribution plate 11 with essentially rectangular base area and by vertical to slightly inclined side walls. Here, the side walls of the fluidizing space II can be inclined up to a maximum of 10° from the vertical. In the fluidizing space II, which is flowed through by the process air 1 from the bottom to the top, the fluidized solid is located, which forms the fluidized bed 9. In the area of the fluidizing space II, a binder, water and/or one or more material components in the form of solutions, suspensions or melts are supplied to the solid material in the fluidized bed 9 over the entire process area using a spray or injection system 8. The dry material proportion in the spray medium amounts to about 0 to 100%, while the binder proportion in the final product including the moisture amounts to about 1 to 35%.

The spray system 8 comprises a known single or multiple stage nozzle, wherein the injection direction can be accomplished from top to bottom, or vice versa, or at an angle. By the creation of the fluidizing space II and the supply of additional components via the spray system 8, a homogenous solid mixture results, wherein granulates are formed having a homogenous composition formed from the respective individual components.

Above the fluidizing space II is connected the expansion zone III, in which the flow speed of the process air 1 is reduced by cross-sectional widenings. The side walls of the expansion zone III exhibit a steep inclination of 15–45° to the vertical, so that a cross-sectional widening up to the connected filter system IV results. By the reduction of the flow speed of the process air 1, a pre-separation of particles entrained from the fluidizing space II occurs, which is conveyed back into the fluidizing space.

An integrated filter system IV is connected to the expansion zone III to remove the dust from the process air 1 and, at the same time, return the dust into the fluidized bed 9 located beneath it. The filter system IV comprises filter elements 7, which can be cleaned mechanically by the filter deduster 6 and/or by compressed air 5 in pulses. The use of other known filter elements is possible. With the integrated filter system IV, contact with the dusts is prevented, and the danger of dust explosion in the interior of the fluidized bed apparatus is reduced.

The cleaned process air leaves the system as exhaust air 4, while the finished product is likewise carried out from the system via a cellular wheel sluice 12 as a pressure lock via the product discharge 3.

The system can have added to it further equipment components, for example for suppression/reduction of explosions or for supporting the solid material movement, e.g. by vibrating devices.

The invention will now be illustrated in detail with reference to the following specific, non-limiting examples.

EXAMPLE 1

Detergent powder having a particle size smaller than 200 μm was agglomerated in a fluidized bed having two chambers in the inflow area and having a fluidized plate area of 0.2 $m^2$. The chamber conditions were as follows:

| | |
|---|---|
| 1st Chamber | Agglomeration: |
| Supply air temperature | 150° C. |
| Fluidized bed temperature | 60° C. |
| Spray medium | 30% binder solution |
| In the product | 10% binder |
| | 5% water |
| 2nd Chamber | Cooling: |
| Cooling air temperature | 25° C. |
| Exit temperature of detergent agglomerate | 35° C. |
| Partition of the fluidized area: | |
| 75% agglomeration | |
| 25% cooling | |

Solid and uniformly homogenous agglomerates were created, having a particle size of 400 to 800 μm, without dust portions <200 μm, and easily dissolvable in water.

EXAMPLE 2

In this Example, the process was carried out in a standard fluidized bed installation having the following dimensions:

| | |
|---|---|
| Length: | 5.0 m |
| Width of fluidizing space: | 1.0 m |
| Height of fluidizing space: | 0.8 m |
| Height of expansion zone: | 1.0 m |
| Height of entire apparatus: | 5.5 m |
| Total fluidizing surface: | 5 $m^2$ |

The side walls in the fluidizing space were parallel and vertical, and in the expansion zone were inclined at 30° to the vertical. The spraying was from above with a total of eight (8) nozzles.

In the process, 2550 kg/h of a pre-mixed, powdered detergent (active detergent, enzyme, softener, and other adjuvants) were sprayed into the fluidized bed with 1000 kg/h of a 30% binder solution (ethylene glycol polymer in water) and agglomerated therewith. The agglomeration occurred in a first chamber of the fluidized bed installation on a surface of 3.5 $m^2$. The fluidized bed was generated by 18,000 kg/h of hot air at 150° C. The temperature in the fluidized bed was about 60° C. In a second chamber of the fluidized bed the cooling of the agglomerate took place on a surface of 1.25 $m^2$ with 6000 kg/h of cold cooling air at 25° C. This air stream warmed itself to a mean temperature of 45° C.

At the product outlet a mass stream of 3000 kg/h exited at a temperature of 35° C. The air streams from the agglomeration and cooling chambers exited the fluidized bed installation as one exhaust gas stream having a temperature of about 55° C. The inlet moisture of the pre-mixed powder was 0%, while the moisture of the finished product was 5%.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

We claim:

1. A process for manufacturing detergents or detergent components as a product in granulate or agglomerate form on a dry basis in an essentially horizontally oriented fluidized bed, comprising the steps of:

(a) providing a multi-stage fluidized bed for performing different process steps selected from heating, agglomeration, coating, drying, and cooling for manufacturing the product;

(b) supplying solid powdered starting material to the fluidized bed in a fluidizing space;

(c) supplying process air to the different process steps from beneath the fluidizing space, wherein a different process air stream is provided to the fluidizing space by each of at least two chambers in an air inflow area beneath the fluidizing space;

(d) supplying material components comprising a binder and/or water to the solid starting material in the fluidizing space;

(e) fluidizing the starting material and material components in the fluidizing space to form a solid mixture comprising granulates or agglomerates of homogenous composition;

(f) reducing a flow speed of the process air in an expansion zone located above the fluidizing space, such that particles entrained in the process air from the fluidizing space are pre-separated and returned to the fluidizing space; and (g) separating process dust with a dedusting mechanism adjoining above the expansion zone.

2. The process according to claim 1, wherein the at least two chambers are arranged one after another in a horizontal direction of the fluidized bed to provide the different process air streams sequentially to the fluidizing space.

3. The process according to claim 2, wherein the starting material is supplied at one end of the fluidizing space and the granulates or agglomerates of homogenous composition are discharged from an opposite end of the fluidizing space, such that some of the different process steps are performed sequentially in the horizontal direction.

4. The process according to claim 1, wherein a first chamber provides process air at a temperature of about 20° C. up to a decomposition temperature of individual components of the product for agglomeration of the product, and a second process chamber provides process air at a temperature of about −20° C. to +30° C. for cooling the agglomerated product.

5. The process according to claim 1, wherein the material components supplied in step (d) are supplied by a spray or injection system.

6. The process according to claim 5, wherein the material components supplied in step (d) are supplied in a spray medium comprising up to 100% dry material.

7. The process according to claim 5, wherein the material components supplied in step (d) are supplied over an entire process range.

8. The process according to claim 1, wherein the material components supplied in step (d) are supplied in a form selected from the group consisting of solutions, suspensions and melts.

9. The process according to claim 1, wherein the material components supplied in step (d) are supplied from above the fluidizing space.

10. The process according to claim 1, wherein the expansion zone is formed by cross-sectional widenings of the fluidized bed.

11. The process according to claim 1, wherein the dedusting mechanism of step (g) is in an integrated filter system.

12. The process according to claim 1, wherein the process dust separated in step (g) is returned to the fluidizing space.

13. The process according to claim 1, wherein the fluidizing space is separated from the chambers in the air inflow area by an air distribution plate.

14. The process according to claim 1, wherein the different process air streams exit the fluidized bed as one exhaust gas stream.

15. The process according to claim 1, wherein the product comprises about 1 to 35% binder including moisture.

16. The process according to claim 1, wherein supplying the starting material to and discharging the product from the fluidized bed are performed under pressure seal from the environment.

17. The process according to claim 1, wherein the product is a finished product.

* * * * *